US008470388B1

(12) United States Patent
Zsinko et al.

(10) Patent No.: US 8,470,388 B1
(45) Date of Patent: Jun. 25, 2013

(54) ELECTROLUMINESCENT DEVICES AND THEIR MANUFACTURE

(71) Applicants: Andrew Zsinko, Medina, OH (US); Shawn J. Mastrian, Austin, TX (US)

(72) Inventors: Andrew Zsinko, Medina, OH (US); Shawn J. Mastrian, Austin, TX (US)

( * ) Notice: Subject to any disclaimer, the term of this patent is extended or adjusted under 35 U.S.C. 154(b) by 0 days.

(21) Appl. No.: 13/677,864

(22) Filed: Nov. 15, 2012

Related U.S. Application Data

(63) Continuation of application No. 13/624,910, filed on Sep. 22, 2012.

(60) Provisional application No. 61/582,581, filed on Jan. 3, 2012.

(51) Int. Cl.
*B05D 5/06* (2006.01)

(52) U.S. Cl.
USPC ..... 427/64

(58) Field of Classification Search
USPC ..... 427/64
See application file for complete search history.

(56) References Cited

U.S. PATENT DOCUMENTS

| | | | | |
|---|---|---|---|---|
| 3,995,157 | A | 11/1976 | Holub et al. | |
| 4,159,559 | A | 7/1979 | Robinson, Sr. | |
| 5,030,833 | A * | 7/1991 | Nozaka et al. | 250/461.1 |
| 5,491,377 | A | 2/1996 | Janusauskas | |
| 5,780,965 | A | 7/1998 | Cass et al. | |
| 6,538,725 | B2 | 3/2003 | Potyrailo et al. | |
| 6,639,355 | B1 | 10/2003 | Pennaz et al. | |
| 6,835,112 | B2 * | 12/2004 | Tanabe et al. | 445/50 |
| 6,926,972 | B2 * | 8/2005 | Jakobi et al. | 428/690 |
| 6,965,196 | B2 | 11/2005 | Murasko et al. | |
| 7,168,838 | B2 | 1/2007 | Moser | |
| 7,412,088 | B2 | 8/2008 | Kuramata et al. | |
| 7,439,672 | B2 | 10/2008 | Enz | |

(Continued)

FOREIGN PATENT DOCUMENTS

| | | | |
|---|---|---|---|
| EP | 1110816 | A2 | 6/2001 |
| JP | 11162633 | A | 6/1999 |

OTHER PUBLICATIONS

Brochure, "Spherical Light Coating," www.xtra-dynannics.com, captured by www.archive.org Sep. 14, 2008, visited Mar. 29, 2012. German-language brochure with attached machine-translation to English.

(Continued)

*Primary Examiner* — Michael Cleveland
*Assistant Examiner* — Robert Vetere
(74) *Attorney, Agent, or Firm* — James Eley; Michael Forhan; Eley Law Firm Co., LPA

(57) ABSTRACT

A process for producing a conformal electroluminescent system. An electrically conductive base backplane film layer is applied upon a substrate. A dielectric film layer is applied upon the backplane film layer, then a phosphor film layer is applied upon the dielectric film layer. An electrode film layer is applied upon the phosphor film layer using a substantially transparent, electrically conductive material. An electrically conductive bus bar may be applied upon the electrode film layer. Preferably, the backplane film layer, dielectric film layer, phosphor film layer, electrode film layer and bus bar are aqueous-based and are applied by spray conformal coating. The electroluminescent phosphor is excitable by an electrical field established across the phosphor film layer such that the device emits electroluminescent light upon application of an electrical charge between the backplane film layer and at least one of the electrode film layer and the bus bar.

15 Claims, 13 Drawing Sheets

U.S. PATENT DOCUMENTS

| | | | | |
|---|---|---|---|---|
| 7,698,842 | B2 | 4/2010 | Fitzke et al. | |
| 7,910,400 | B2 | 3/2011 | Kwon et al. | |
| 2003/0022018 | A1 | 1/2003 | Baumberg et al. | |
| 2004/0080256 | A1* | 4/2004 | Hampden-Smith et al. | 313/467 |
| 2004/0183434 | A1* | 9/2004 | Yeh et al. | 313/506 |
| 2005/0062395 | A1 | 3/2005 | Takahashi et al. | |
| 2005/0067952 | A1 | 3/2005 | Fechter et al. | |
| 2005/0191520 | A1 | 9/2005 | Guntermann et al. | |
| 2006/0132028 | A1 | 6/2006 | Anderson | |
| 2009/0212690 | A1 | 8/2009 | Bruton et al. | |
| 2009/0236984 | A1 | 9/2009 | Werners et al. | |
| 2009/0252933 | A1 | 10/2009 | Free et al. | |
| 2010/0209724 | A1 | 8/2010 | Hartmann et al. | |
| 2011/0050094 | A1 | 3/2011 | Enz et al. | |

OTHER PUBLICATIONS

James Deardorff, "Shining a Black Light on Coating Inspections," www.photonics.com, Nov. 1, 2010, visited Aug. 28, 2012.

* cited by examiner

ELECTROLUMINESCENT DEVICES AND THEIR MANUFACTURE

This application claims priority to U.S. provisional application 61/582,581, filed Jan. 3, 2012, the contents of which are hereby incorporated by reference.

FIELD

The present invention relates to a system for producing electroluminescent devices having a lower backplane electrode layer and an upper electrode layer, the lower and upper electrode layers being connectable to an electrical driving circuit. One or more functional layers are disposed between the lower and upper electrode layers to form at least one electroluminescent area.

BACKGROUND

Since the 1980s, electroluminescent (EL) technology has come into widespread use in display devices where its relatively low power consumption, relative brightness and ability to be formed in relatively thin-film configurations have shown it to be preferable to light emitting diodes (LEDs) and incandescent technologies for many applications.

Commercially manufactured EL devices have traditionally been produced using doctor blade coating and printing processes such as screen printing or, more recently, ink jet printing. For applications that require relatively planar EL devices these processes have worked reasonably well, as they lend themselves to high-volume production with relatively efficient and reliable quality control.

However, traditional processes are inherently self limiting for applications where it is desirable to apply an EL device to a surface having complex topologies, such as convex, concave and reflexed surfaces. Partial solutions have been developed wherein a relatively thin-film EL "decal" is applied to a surface, the decal being subsequently encapsulated within a polymer matrix. While moderately successful, this type of solution has several inherent weaknesses. Firstly, while decals can acceptably conform to mild concave/convex topologies, they are incapable of conforming to tight-radius curves without stretching or wrinkling. In addition, the decal itself does not form either a chemical or mechanical bond with an encapsulating polymer, essentially remaining a foreign object embedded within the encapsulating matrix. These weaknesses pose difficulties in both manufacturing and product life-cycle, as embedded-decal EL lamps applied to complex topologies are difficult to produce and are susceptible to delamination due to mechanical stresses, thermal stresses and long-term exposure to ultraviolet (UV) light. There remains a need for a way to produce an EL lamp that is compatible with items having a surface incorporating complex topologies.

SUMMARY

A process is disclosed according to an embodiment to the present invention whereby an EL device is "painted" onto a surface or "substrate" of a target item to which the EL device is to be applied. The present invention is applied to the substrate in a series of layers, each of which performs a specific function integral to the process.

One object of the present invention is a process for producing a conformal electroluminescent system. The process includes the step of selecting a substrate. A base backplane film layer is applied upon the select substrate using an aqueous-based, electrically conductive backplane material. A dielectric film layer is applied upon the backplane film layer using an aqueous-based dielectric material. A phosphor film layer is applied upon the dielectric film layer using an aqueous-based phosphor material, the phosphor film layer being excited by an ultraviolet radiation source during application. The ultraviolet radiation source provides visual cues while the phosphor film layer is being applied, and the application of the phosphor film layer is adjusted in response to the visual cues to apply a generally uniform distribution of the phosphor material upon the dielectric film layer. An electrode film layer is applied upon the phosphor film layer using an aqueous-based, substantially transparent, electrically conductive electrode material. The backplane film layer, dielectric film layer, phosphor film layer, and electrode film layer are each preferably applied by spray conformal coating. The phosphor film layer is excitable by an electrical field established across the phosphor film layer upon application of an electrical charge between the backplane film layer and the electrode film layer such that the phosphor film layer emits electroluminescent light.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
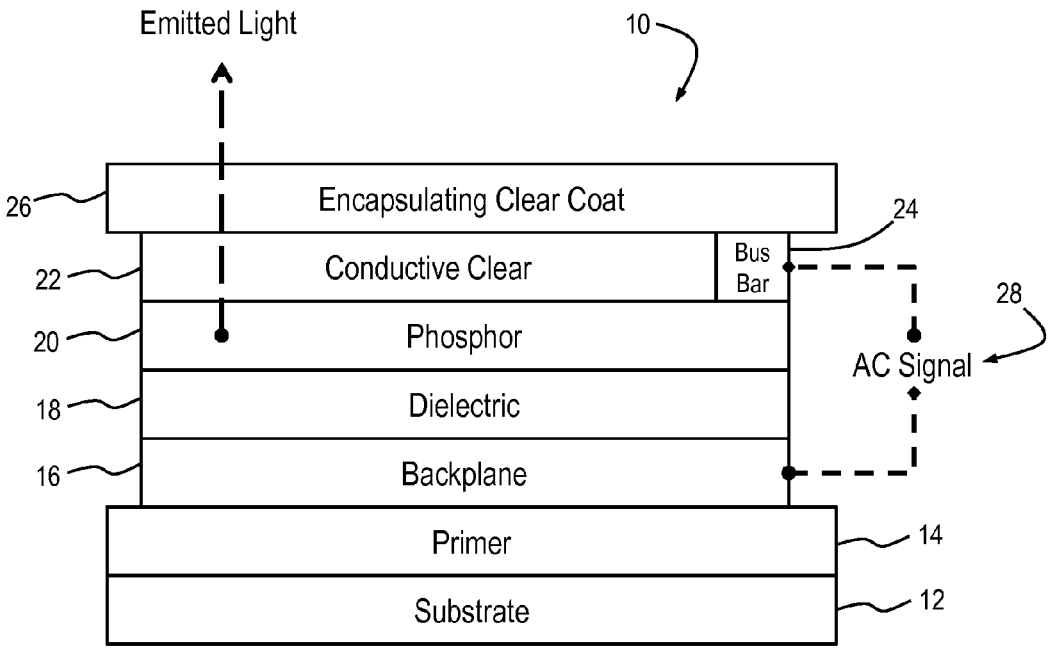
FIG. 1 is a schematic layer diagram of an EL lamp according to an embodiment of the present invention.

In the discussion that follows, like reference numerals are used to refer to like elements and structures in the various figures.

The general arrangement of a conformal EL lamp 10 is shown in FIG. 1 according to an embodiment of the present invention. EL lamp 10 comprises a substrate 12, a primer layer 14, an electrically conductive backplane electrode layer 16, a dielectric layer 18, a phosphor layer 20, a substantially transparent, electrically conductive top electrode 22, a bus bar 24 and an optional encapsulating layer 26.

Substrate 12 may be a select surface of any suitable target item upon which EL lamp 10 is to be applied. Substrate 12 may be conductive or non-conductive, and may have any desired combination of convex, concave and reflexed surfaces. In some embodiments of the present invention substrate 12 is a transparent material such as, without limitation, glass or plastic.

Primer layer 14 is a non-conductive film coating applied to substrate 12. Primer layer 14 serves to electrically insulate substrate 12 from subsequent conductive and semi-conductive layers, discussed further below. Primer layer 14 also preferably promotes adhesion between substrate 12 and subsequent layers.

Conductive backplane 16 is a film coating layer that is preferably masked over primer layer 14 to form a bottom electrode of EL lamp 10. Conductive backplane 16 is preferably a sprayable conductive material and may form the rough outline of the lit EL "field" of the finished EL lamp 10. The material selected for backplane 16 may be tailored as desired to suit various environmental and application requirements. In one embodiment backplane 16 is made using a highly conductive, generally opaque material. Examples of such materials include, without limitation, an alcohol/latex-based, silver-laden solution such as SILVASPRAY™ available from Caswell, Inc. of Lyons New York, and a water-based latex, copper-laden solution such as "Caswell Copper" copper conductive paint, also available from Caswell, Inc.

In one embodiment a predetermined amount of silver flake may be mixed with the copper conductive paint. Empirical testing has shown that the addition of silver flake significantly enhances the performance of the copper conductive paint without adversely affecting its relatively environmentally-friendly characteristics.

As an alternative to either Caswell SILVASPRAY™ or Caswell Copper, silver flake may be mixed in a solution of an aqueous-based styrene acrylic co-polymer solution (discussed further below) and ammonia to encapsulate the silver for application to a prepared surface (i.e., substrate) as a backplane 16 material.

Conductive backplane 16 may also be a metal plating wherein a suitable conductive metal material is applied to a non-conductive substrate 12 using any suitable process for the select metal plating. Example types of metal plating include, without limitation, electroless plating, vacuum metalizing, vapor deposition and sputtering. Preferably, the resulting electrically conductive backplane 16 has a relatively low resistance to minimize voltage gradients across the surface of the backplane to allow for the proper operation of the electroluminescent system (i.e., sufficient lamp brightness and brightness uniformity). In some embodiments the resistance of a plated backplane 16 is preferably less than about one ohm per square inch of surface area.

Conductive backplane 16 may also be an electrically conductive, generally clear layer such as, without limitation, "CLEVIOS™ S V3" and or "CLEVIOS™ S V4" conductive polymers, available from Heraeus Clevios GmbH of Leverkusen, Germany. This configuration may be preferred for use with target items having generally transparent substrates, such as glass and plastic, and for embodiments where a thinner total application of layers for EL lamp 10 is desired.

Dielectric layer 18 is an electrically non-conductive film coating layer comprising a material (typically Barium Titanate—$BaTiO_3$) possessing high dielectric constant properties encapsulated within an insulating polymer matrix having relatively high permittivity characteristics (i.e., an index of a given material's ability to transmit an electromagnetic field). In one embodiment of the present invention dielectric layer 18 comprises about a 2:1 solution of co-polymer and dilute ammonium hydroxide. To this solution a quantity of $BaTiO_3$, which has been pre-wetted in ammonium hydroxide, is added to form a supersaturated suspension. In various embodiments of the present invention dielectric layer 18 may comprise at least one of a titanate, an oxide, a niobate, an aluminate, a tantalate, and a zirconate material, among others.

Dielectric layer 18 serves two functions. Firstly, dielectric layer 18 provides an insulating barrier between backplane layer 16 and the superimposed semi-conductive phosphor 20, top electrode 22 and bus bar 24 layers. In addition, because of the unique electromagnetic polarization characteristics of the dielectric materials, dielectric layer 18 serves to enhance the performance of the electromagnetic field generated between the backplane 16 and top electrode 22 layers when an AC signal 28 is applied between the backplane and the top electrode. In addition, despite being an efficient electrical insulator, the high dielectric quality of the $BaTiO_3$ and the high permittivity of the polymer matrix are highly permeable to the electrostatic field generated between backplane 16 and top electrode 22

Furthermore, in multiple-layer EL lamp applications a dielectric layer 18 having photorefractive qualities may be selected wherein an index of refraction of the dielectric layer is affected by an electric field applied to backplane 16 and electrode 22 by AC signal 28 (FIG. 1). These photorefractive qualities of the select dielectric layer 18 material may be utilized to facilitate the propagation of light through superimposed layers of the EL lamp. A non-limiting example material having photorefractive properties is $BaTiO_3$.

Phosphor layer 20 is a semi-conductive film coating layer comprised of a material (typically metal-doped Zinc Sulfide (ZnS)) encapsulated within a highly electrostatically permeable polymer matrix. When excited by the presence of an alternating electrostatic field generated by AC signal 28, the doped ZnS absorbs energy from the field, which it in turn re-emits as a visible-light photon upon returning to its ground state. Phosphor layer 20 serves two functions. Firstly, while the metal-doped Zinc Sulfide phosphor is technically classed as a semiconductor, when encapsulated within the co-polymer matrix, it further effectively provides an additional insulating barrier between the backplane 16 layer and the superimposed top electrode 22 and bus bar 24 layers. In addition, once excited by the presence of an alternating electromagnetic field, phosphor layer 20 emits visible light.

In one embodiment of the present invention phosphor layer 20 comprises about a 2:1 solution of co-polymer and dilute ammonium hydroxide. To this solution, a quantity of metal-doped Zinc Sulfide based phosphors doped with at least one of copper, manganese and silver (i.e., ZnS:Cu, Mn, Ag, etc.) pre-wetted in a dilute ammonium hydroxide is added to form a supersaturated suspension.

Preferably, an aqueous-based styrene acrylic co-polymer solution (hereafter "co-polymer") is utilized as an encapsulating matrix for both dielectric layer 18 and phosphor layer 20. This material is suitable for close-proximity and long-term contact without adverse impact to organisms or the environment. An example co-polymer is DURAPLUS™ polymer matrix, available from the Dow Chemical Company of Midland, Mich. A significant advantage of the co-polymer is that it provides a chemically benign and versatile bonding mechanism for a variety of sub- and top-coating options on a select substrate 12. Ammonium hydroxide may be used as a thinner/drying agent for the co-polymer.

During production of EL lamp 10, after volatile components of the co-polymer solution of dielectric layer 18 and phosphor layer 20 have been eliminated (typically by evaporation) during a curing process, the resultant coatings are largely chemically inert. As such, the dielectric layer 18 and phosphor layer 20 coatings do not readily react chemically with under- or over-lying layers and, as a result, encapsulates and protects the homogeneous dielectric 18 and phosphor particle 20 layer distributions.

Chemically, during a curing process, open ends of a long-chain co-polymer of dielectric layer 18 and phosphor layer 20 are exposed. This provides a ready mechanism for the creation of a strong mechanical bond between chemically dissimilar layers, as the exposed polymer chain ends essentially act as a "hook" analogous to the hook portion of a hook-and-loop fastener. These hooks provide a relatively porous surface topology that readily accepts infiltration by the application of a second long-chain polymer solution. As the secondary layer cures, its polymer chain ends are exposed and essentially "knit" with the aforementioned exposed co-polymer ends to form a strong mechanical bond between adjacent layers.

Top electrode 22 is a film coating layer that is preferably both electrically conductive and generally transparent to light. Top electrode 22 may be from such materials as, without limitation, conductive polymers (PEDOT), carbon nanotubes (CNT), antimony tin oxide (ATO) and indium tin oxide (ITO). A preferred commercial product is CLEVIOS™ conductive, transparent and flexible polymers (available from Heraeus Clevios GmbH of Leverkusen, Germany) diluted in isopropyl alcohol as a thinner/drying agent. CLEVIOS™ conductive polymers exhibit relatively high efficacy and are relatively environmentally benign. In addition, CLEVIOS™ conductive polymers are based on a styrene co-polymer and thus provides a ready mechanism for chemical crosslinking/mechanical bonding with the underlying phosphor layer 20.

Alternate materials may be selected for top electrode 22 solutions, including those containing Indium Tin Oxide (ITO) and Antimony Tin Oxide (ATO). However, these are less desirable than CLEVIOS™ conductive polymers due to greater environmental concerns.

In some embodiments of the present invention it may be desirable for backplane electrode layer 16 to be generally transparent. In such cases any of the materials discussed above for top electrode 22 may be utilized for backplane electrode layer 16.

The efficiency of top electrode 22 materials are hampered by their divergent operating requirements; that of both being electrically conductive while also being generally transparent to visible light. As the area of lit fields of an EL lamp 10 become larger, a point of diminishing returns is approached wherein the thickness of the top electrode layer 22 to achieve a sufficiently low resistivity for the necessary voltage distribution across the top electrode layer becomes optically inhibitive or, conversely, the thickness of the top electrode becomes unacceptably electrically inefficient. As a result, it is often desirable to augment the transparent top electrode layer 22 with a more efficient electrical conductor as close to the lit field at possible, in order to minimize the thickness of top electrode layer for optimum optical characteristics. Bus bar 24 fulfills this requirement by providing a relatively low-impedance strip of conductive material, usually comprised of one or more of the materials usable to produce as conductive backplane 16. Bus bar 24 is typically applied to the peripheral edge of the lit field.

Although bus bar 24 is generally shown as adjacent to top electrode layer 22 in the figures, in practice the bus bar may be applied upon (i.e., atop) the top electrode layer. Conversely, top electrode layer 22 may be applied upon (i.e., atop) the bus bar 24.

Once applied, top electrode 22 and bus bar 24 are susceptible to damage due to scratches or marking. After curing the top electrode 22 and bus bar 24 it is preferable to encapsulate EL lamp 10 with an encapsulating clear coat film layer 26 such as a clear polymer 26 of suitable hardness to protect the EL lamp from damage. Encapsulating layer 26 is preferably an electrically insulating material applied over the EL lamp 10 stack-up, thereby protecting the lamp from external damage. Encapsulating layer 26 is also preferably generally transparent to light emitted by the EL lamp 10 stack-up and is preferably chemically compatible with any envisioned top-coating materials for the target item of substrate 12 that provide a mechanism for chemical and/or mechanical bonding with topcoating layers. Encapsulating layer 26 may be comprised of any number of aqueous, enamel or lacquer-based products.

As previously noted, current EL products are limited to application to relatively simple topographical surfaces that are planar or nearly planar. This is because screen/inkjet print-based processes require a flat or nearly flat surface to assure proper distribution ratios of the required components in the respective layers. Unlike print-based EL production processes, primer layer 14, backplane 16, dielectric layer 18, phosphor layer 20, conductive top electrode 22, bus bar 24 and encapsulating layer 26 are preferably formulated to be compatible with and applied by both tools and methods commonly available to and within the purview of the painter's craft. Thus, EL lamp 10 may be "painted" onto substrate 12 as a stackup of conformal coats comprising primer layer 14, backplane 16, dielectric layer 18, phosphor layer 20, conductive top electrode 22, bus bar 24 and encapsulating layer 26. By utilizing select components of the respective layers and application techniques as disclosed herein that are compatible with spray-based equipment, EL lamps 10 may be applied to a wide variety of materials and/or complex topologies such that any "paintable" substrate 12 surface can be utilized for the application of a conformal, energy-efficient EL lamp. Accordingly, EL lamp 10 is "conformal" in the sense that it conforms to the shape and geometry of substrate 12.

Figure 2:
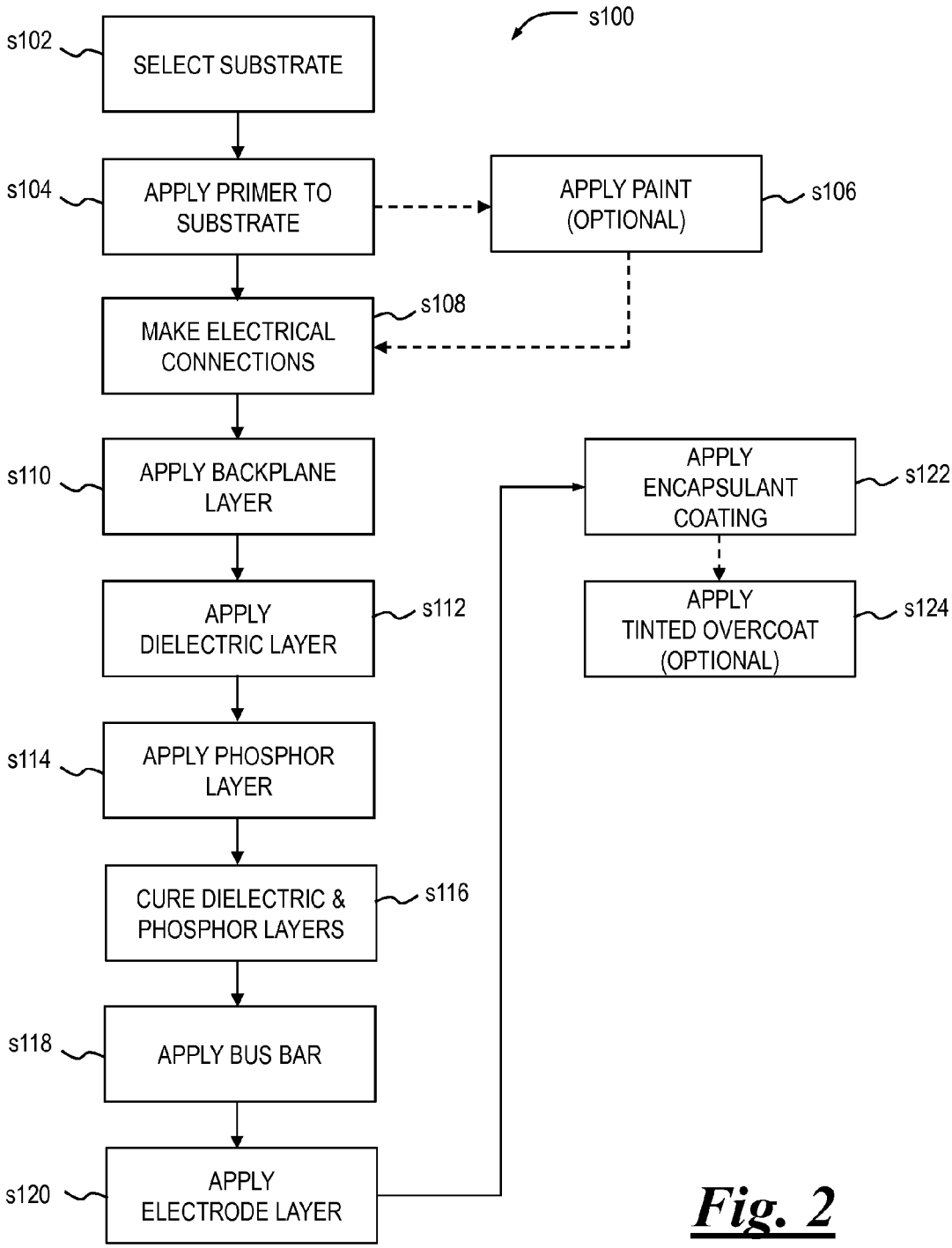
FIG. 2 is a flow diagram of a process for producing electroluminescent lamps according to an embodiment of the present invention.

With reference to FIG. 2 in combination with FIG. 1, a process s100 for producing EL lamps will now be described.

At s102 a substrate 12 is selected. Substrate 12 is typically a surface of a select target item, which may be made from any suitable conductive or non-conductive material, and may have any desired contours and shapes.

A primer layer 14 is applied to substrate 14 at s104. Whether the intended target item substrate 12 is conductive, i.e., metal, or carbon fiber or non conductive, i.e., some form of glass, plastic, fiberglass or composite material, it is preferable to apply a quantity of a compatible oxide-based primer to the substrate in a relatively thin layer to seal the surface, provide electrical insulation between the substrate and the EL lamp 10, and insure adhesion with overlying topcoat layers. In some circumstances, it may also be desirable to apply at s106 a thin layer of a suitable enamel/lacquer/aqueous paint, compatible with the intended topcoat, over the oxide primer layer. "Topcoat" as used herein refers generally to any coating placed over the finished EL lamp 10, such as a translucent coating covering the EL lamp and portions of substrate 12 not covered by the EL lamp. The optional painting step of s106 is particularly attractive when the target item comprising substrate 12 is to be subjected to prolonged handling before further EL lamp 10 layers are applied. Because of the relative "softness" of oxide-based primers, exposed primer surfaces can be degraded by frequent handling and the resultant oxide dust can stain the raw surface.

For each EL "lit field" on a given surface, two electrical connections are provided at s108 to provide a pathway for the AC signal 28 (FIG. 1) that excites phosphor layer 20. There are two basic mechanisms for installing these electrical pathways, the selection of which is determined by the characteristics of the substrate 12 of the target item. With additional reference to FIG. 3, for non-conductive plastic, fiberglass or composite target item substrates 12, it is preferable to provide one or more "carrythrough" conductive elements 30-1, 30-2 to backplane 16 and bus bar 24 respectively of EL lamp 10 via small openings 32 in substrate 12 of the target item and primer layer 14 to provide electrical contact with the overlying backplane and bus bar.

For some forms of conductive substrate 12 target items, the carrythrough technique is also effective, given the inclusion of an insulating sheath 34 between the substrate and the signal pathway. This is both a practical and a safety consideration, as the electrical current demand placed on the system by needlessly energizing the substrate/target item significantly reduces the power consumption efficiency of the system as a whole and increases safety by electrically isolating the EL lamp 10 field from a conductive substrate 12 of the target item and any pathways to a ground state, such as a defect in the substrate of the target item.

Figure 3:
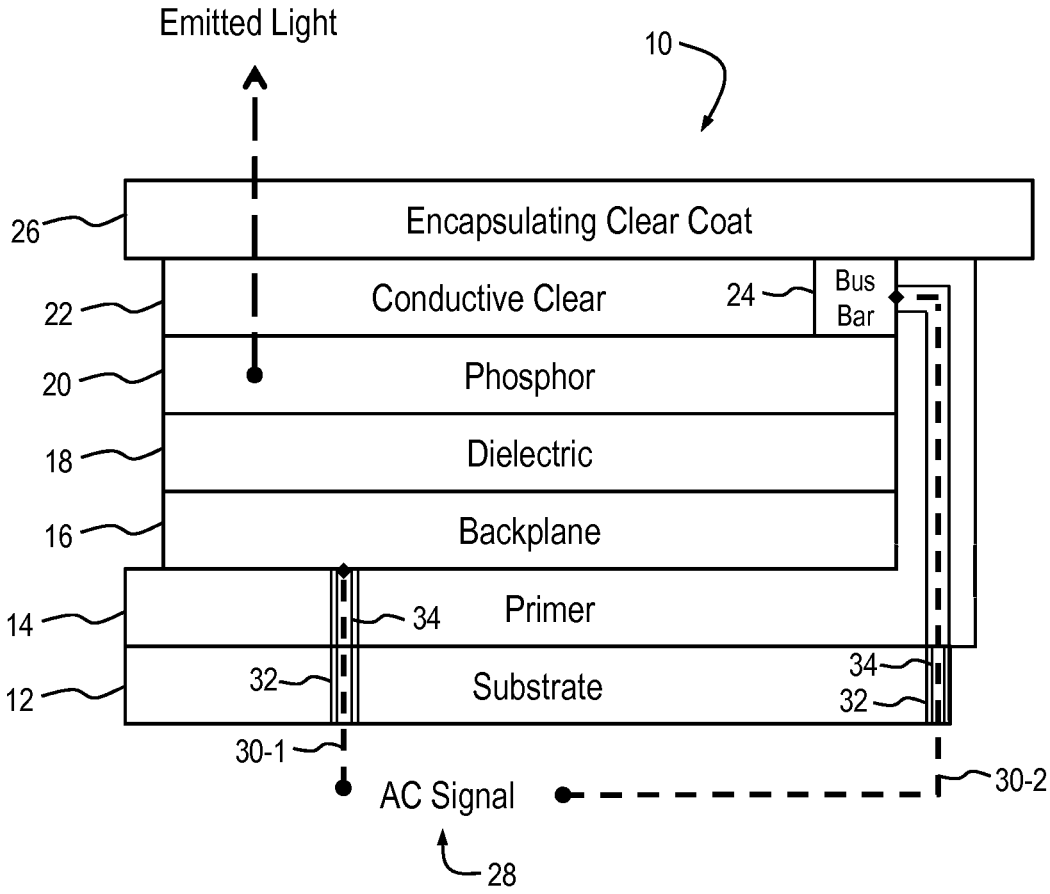
FIG. 3 is a schematic layer diagram of an EL lamp showing routing of conductive elements according to an embodiment of the present invention.
Figure 4:
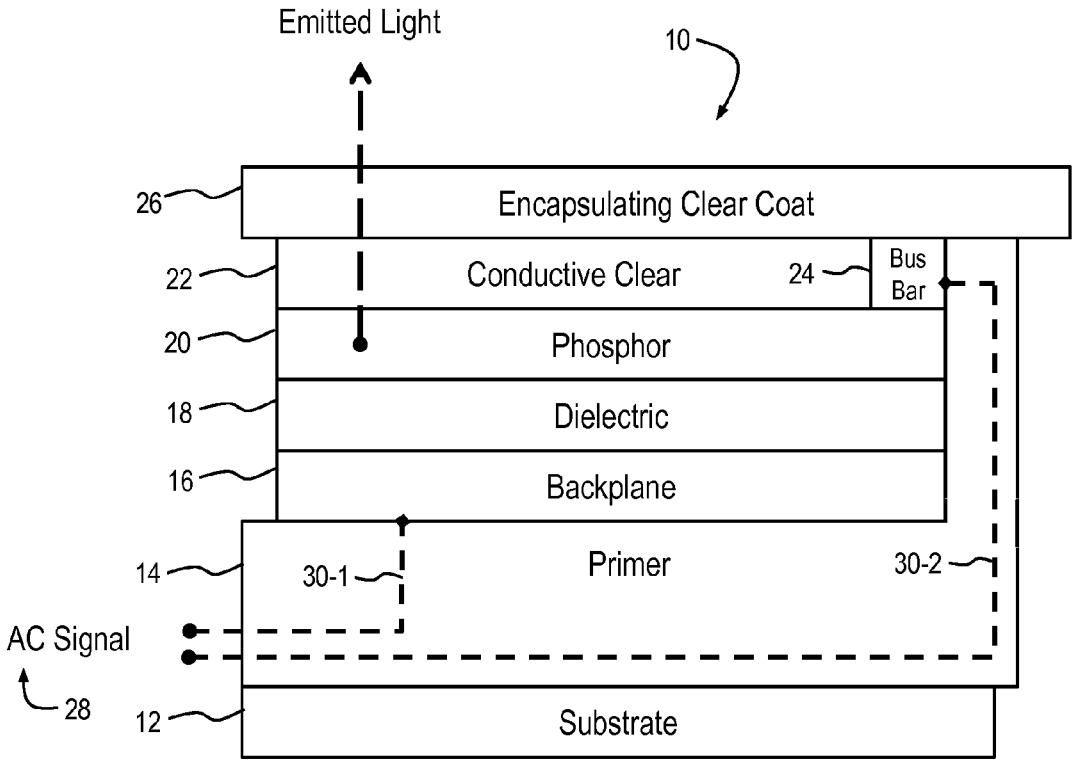
FIG. 4 is a schematic layer diagram of an EL lamp showing routing of conductive elements according to another embodiment of the present invention.

When structural or practical considerations (such as maintaining the integrity of a fluid containment vessel) prohibit using the aforementioned carrythrough technique of FIG. 3 on a substrate 12 of a target item, signal paths to EL lamp 10 may be provided by embedding conductive elements 30-1 and 30-2 within the insulating primer layer 14 and, if required, "wrap around" a panel edge as shown in FIG. 4. Either of the method of FIGS. 3 and 4 for providing signal access to the backplane 16 and bus bar 24, i.e., "carrythrough" or "wrap around," are functionally equivalent and may be selected based upon particular conditions and requirements imposed by the substrate 12 of the target item.

Backplane layer 16 is applied at s110. Backplane layer 16, as previously discussed, is a pattern comprising a conductive material and is masked over the primer 14 coating. Backplane layer 16 may be applied to any suitable thickness, such as about 0.001 inches, preferably using an airbrush or sufficiently fine-aperture gravity-feed type spray equipment. When so applied, backplane layer 16 is placed into electrical contact with conductive element 30-1 (FIGS. 3, 4) to provide electrical contact with AC signal 28 and also defines the rough outline of the lit EL lamp 10 field.

Dielectric film layer 18 is spray-applied at step s112. The previously-described supersaturated dielectric solution is applied using suction and/or pressure feed type spray equipment under visible light at a predetermined air pressure, adjusted for variables such as ambient temperature and topology of the substrate 12 target item. Dielectric layer 18 is preferably applied at ambient air temperatures of about 70 degrees Fahrenheit or greater. The dielectric layer is preferably applied in successive thin coats of solution to ensure even distribution of the $BaTiO_3$ particulate/polymer solution and prevent excessive buildup that could overcome the surface tension of the solution, which in turn can create a "run" or "droop" within the applied layers. Excessive buildup of material that results in running or drooping of the applied layers leads to an uneven congregation of the encapsulated particulate (referred to as "sand duning") that has a detrimental direct effect on the appearance of the final product. Therefore, it is often desirable to augment the initial air curing of successive applied layers by the application of enhanced infra-red radiation from sources such as direct sunlight and enhanced-infrared lamps between coats for a determinable period of time, depending upon ambient temperature and humidity conditions.

Phosphor layer 20 is applied at s114. The previously-discussed supersaturated phosphor solution is applied using suction and/or pressure feed type spray equipment at a predetermined air pressure, adjusted for variables such as ambient temperature and topology of the substrate 12 of the target item. The phosphor layer 20 is preferably applied proximate (e.g., under) an ultraviolet radiation source such as a long-wave ultraviolet light (e.g., UV "A" or "black light" ultraviolet light) to enhance visible indicators or cues to the operator during application, to ensure relatively uniform particulate distribution. The phosphor layer 20 is preferably applied at ambient air temperatures of about 70 degrees Fahrenheit or greater. The phosphor layer 20 is preferably applied in successive thin coats of solution to ensure even distribution of the ZnS-particulate/polymer solution, and to prevent excessive buildup could overcome the surface tension of the solution, in turn creating a "run" or "droop" within the applied phosphor layers. Like dielectric layer 18, excessive buildup of material that results in "running" or drooping" of the applied layers may lead to an uneven congregation of the encapsulated particulate (i.e., "sand duning") that has a detrimental direct effect on the appearance of the final product. Therefore, it is preferable to augment the initial air curing of successive applied layers by the application of enhanced infra-red radiation by such sources as direct sunlight and enhanced-infrared lamps between coats for a determinable period of time, depending on ambient conditions such as temperature and humidity.

Figure 5:
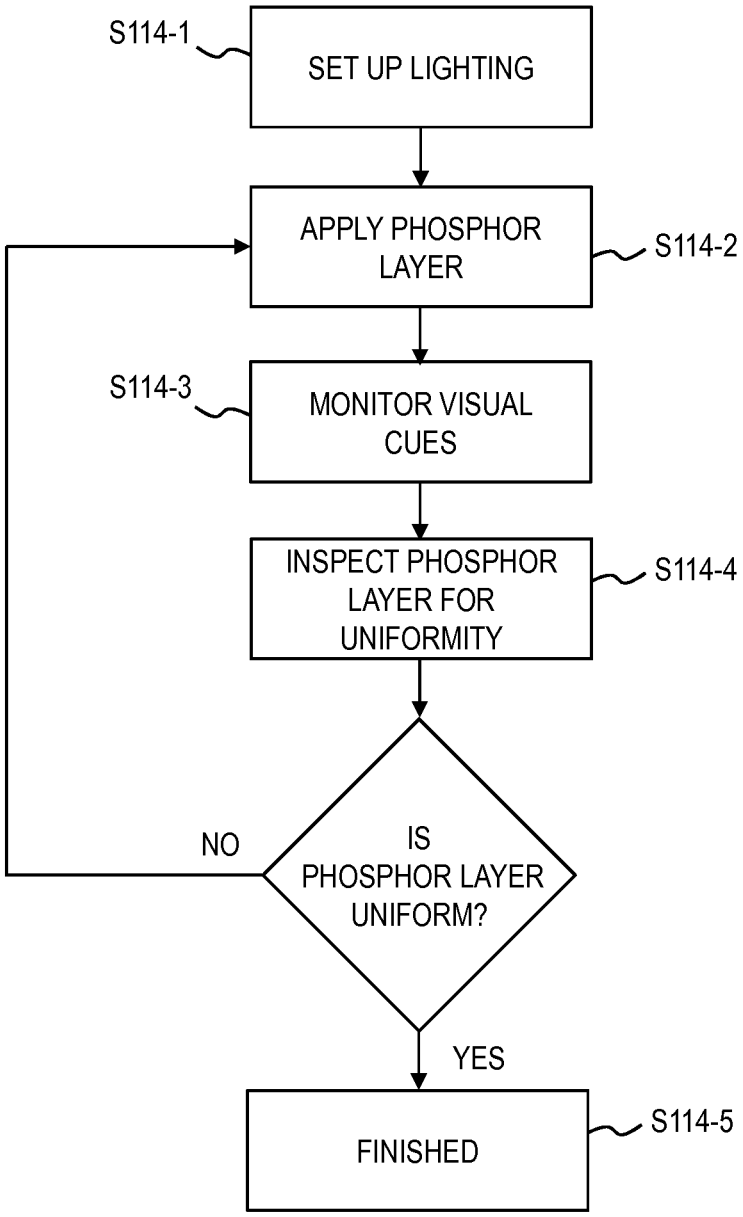
FIG. 5 is a flow diagram of a process for applying a phosphor layer according to an embodiment of the present invention.

Further details of the application of phosphor layer 20 are shown in FIG. 5. The previously-discussed supersaturated phosphor solution is applied using suction and/or pressure feed type spray equipment at a predetermined air pressure, adjusted for variables such as ambient temperature and topology of the substrate 12 of the target item. Phosphor layer 20 is preferably applied under the aforementioned ultraviolet radiation source to enhance visible indicators or cues to the operator during application, to ensure relatively uniform particulate distribution.

At s114-1, prior to the application of phosphor layer 20 an operator preferably arranges an ultraviolet radiation source in such a manner that the ultraviolet radiation source will generally evenly illuminate a target item to be painted. The ultraviolet radiation source is preferably located in a room or other area that is darkened or otherwise substantially devoid of other light sources, so that the ultraviolet radiation source is the primary source of illumination upon the object being painted.

Phosphor layer 20 is applied to the substrate 12 of the target item at s114-2. When applying the phosphor layer, the operator observes that it will glow brightly under the ultraviolet radiation source. This provides a visual cue for the quality of the coating, whereas under a typical ambient white light the operator is not be able to distinguish the phosphor layer 20 from dielectric layer 18 because the two layers will blend visually.

At s114-3, as the operator preferably applies a phosphor film layer 20 comprising one or more relatively thin coats of phosphor under the ultraviolet radiation source the operator will note that the phosphor layer coating becomes more uniform and, accordingly, will know where to apply more or less phosphor layer coating in order to ensure the finished phosphor layer is as uniform as desired. The phosphor film layer 20 being applied is excited by the aforementioned ultraviolet radiation source during application, the ultraviolet radiation source thereby providing the operator with visual cues while the phosphor film layer is being applied. At s114-4 the operator adjusts the application of the phosphor film layer 20 in response to the visual cues to apply a generally uniform distribution of the phosphor material upon the dielectric film layer 18. In some embodiments a phosphor layer of about 0.001 inches or less is preferred. The conformal coating process is finished at s114-5 once the phosphor film layer 20 has reached the desired thickness and uniformity.

Since the dielectric 18 and phosphor 20 layer components of the present invention are chemically identical aside from inert particulate components, functionally they are applied in a contiguous process that chemically forms a single heterogeneous, chemically crosslinked layer distinguished only by the encapsulated inert particulate.

With continued reference to FIG. 2, once a desired thickness and distribution of dielectric 18 phosphor 20 layers have been deposited at steps s112, s114 respectively the resulting coating stack-up is allowed to cure at s116 for a determinable period of time, sufficient to evacuate remaining water content from the dielectric and phosphor layers via evaporation, and also allow a mechanical bond between the applied dielectric/phosphor and backplane 16 layers to form. This period of time varies dependent upon environmental factors, such as temperature and humidity. The process may optionally be accelerated by using the infrared heat sources described above for s112 and s114.

Bus bar 24 is applied at s118. Typically, bus bar 24 is applied using an airbrush or suitable fine-aperture gravity-feed spray equipment such that the bus bar preferably forms an electrically conductive path that generally traces the circumference of a given EL lit field to provide an efficient current source for, and electrical contact with, the transparent top electrode layer 22 and define the outer edge of the desired pattern of the EL field.

For some EL lamps the surface area of the lit field is sufficiently large that a bus bar 24 applied to the periphery of the lit field does not provide adequate voltage distribution to portions of the lamp distant from the bus bar, such as the center of the large rectangular lamp. Likewise, some substrates 12 may have an irregular geometry, resulting in areas of the lit field that are distant from bus bar 24. In such situations bus bar 24 may include one or more "fingers" of bus bar material in electrical communication with the bus bar and extending away from the bus bar to the distant portion(s) of the EL lamp. Similarly, a suitable grid pattern may be in electrical communication with the bus bar 24 and extending away from the bus bar to the distant portion(s) of the EL lamp.

Top electrode 22 is applied over the exposed phosphor layer 20 and bus bar 24 at s120 using an airbrush or suitable fine-aperture gravity feed spray equipment such that the top electrode forms a conductive path that bridges the gap between the bus bar at the circumference of the EL field to provide a generally optically transparent conductive layer over the entirety of the surface area of the EL field. Preferably, top electrode 22 is applied with an operative electrical signal 28 applied to the top electrode and backplane 16 to visually monitor the illumination of phosphor layer 20 during application of the top electrode. This allows the operator to determine whether the top electrode 22 coating has achieved a sufficient thickness and efficiency to allow the EL lamp to illuminate in the manner desired. Each coat is preferably allowed to set under the application of enhanced infrared radiation between each coat to allow for air evaporation of the solution's aqueous/alcohol components. The number of coats required is determined by the uniformity of the distribution of the material, as well as specific local conductivity as determined by the physical distance between any bus bar 24 gaps.

Encapsulating layer 26 is applied at s122. Preferably, encapsulating layer 26 is applied so as to completely cover the stack-up of EL lamp 10, thereby protecting the EL lamp from damage.

Figure 6:
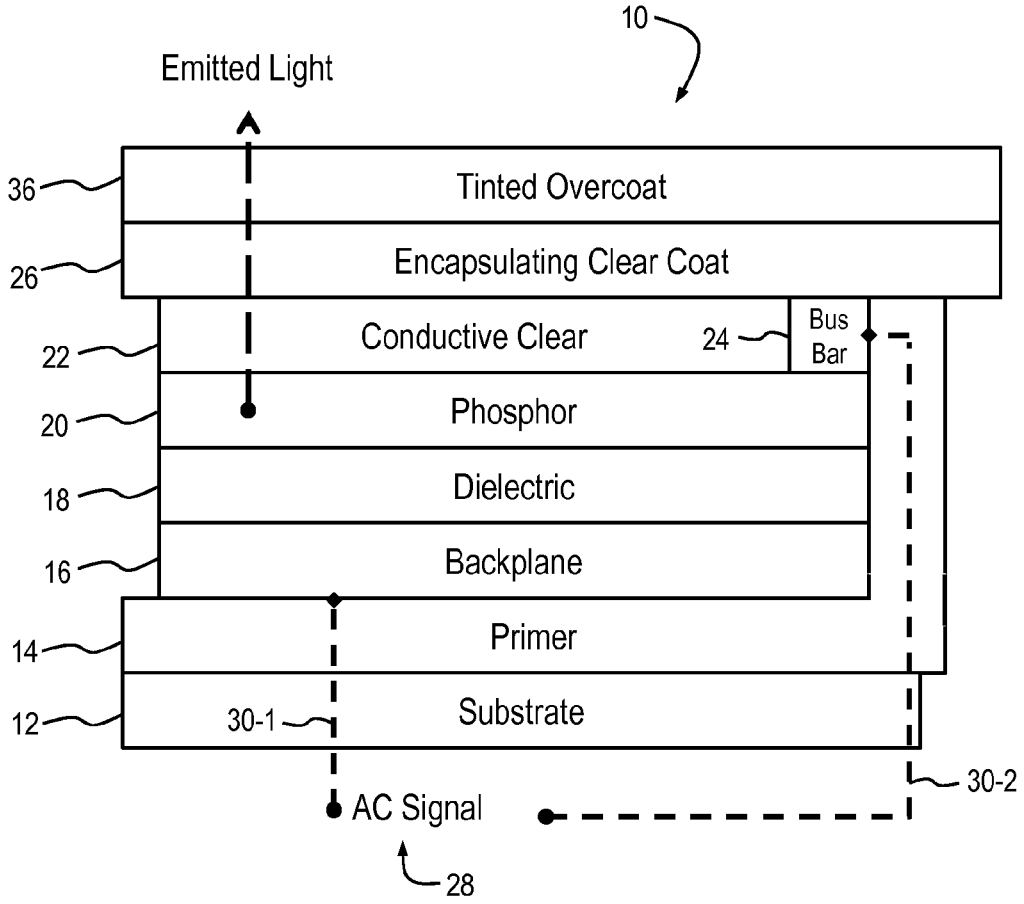
FIG. 6 is a schematic layer diagram of an EL lamp having a tinted overcoat according to an embodiment of the present invention.

In some embodiments of the present invention EL lamp 10 may include additional features to manipulate the apparent color emitted by the lamp. In one such embodiment a pigment-tinted overcoat 36 is applied at s124 (FIG. 2) over EL lamp 10, as shown in FIG. 6.

Figure 7:
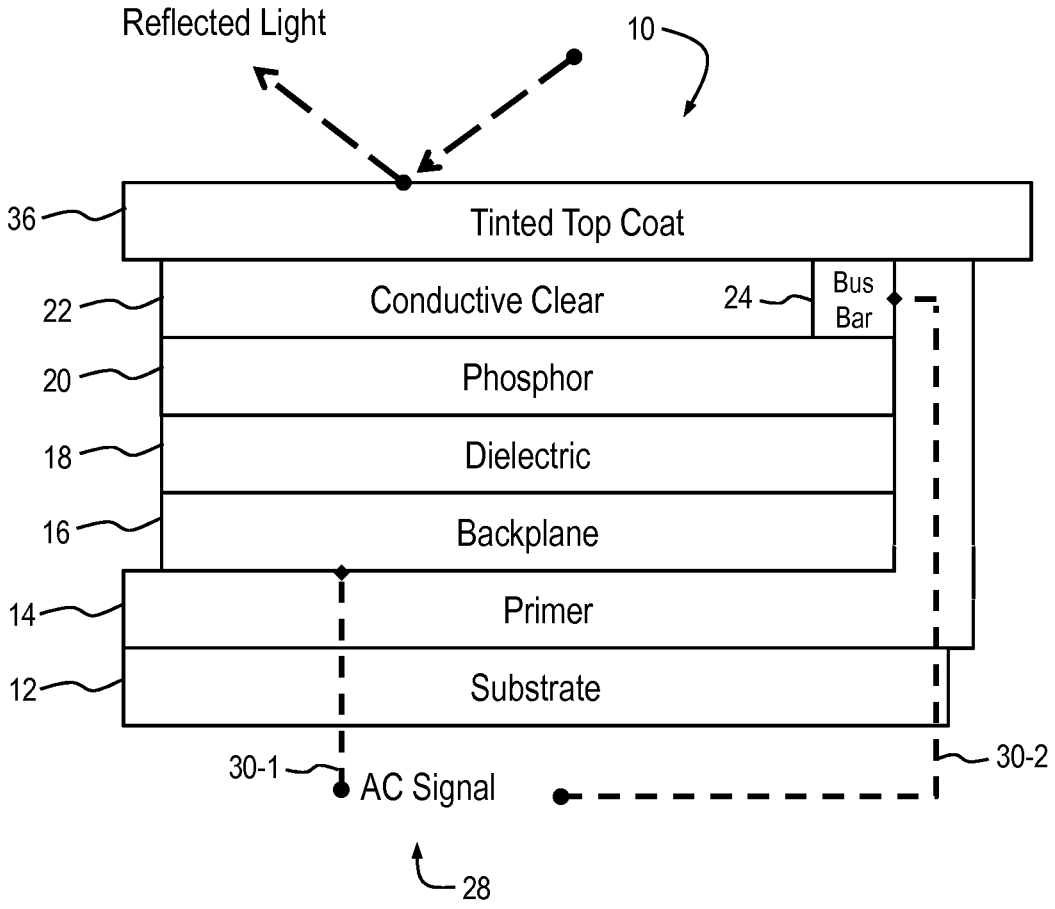
FIG. 7 is a schematic layer diagram showing light being reflected from the tinted overcoat of FIG. 6 and giving color effect to the light.
Figure 8:
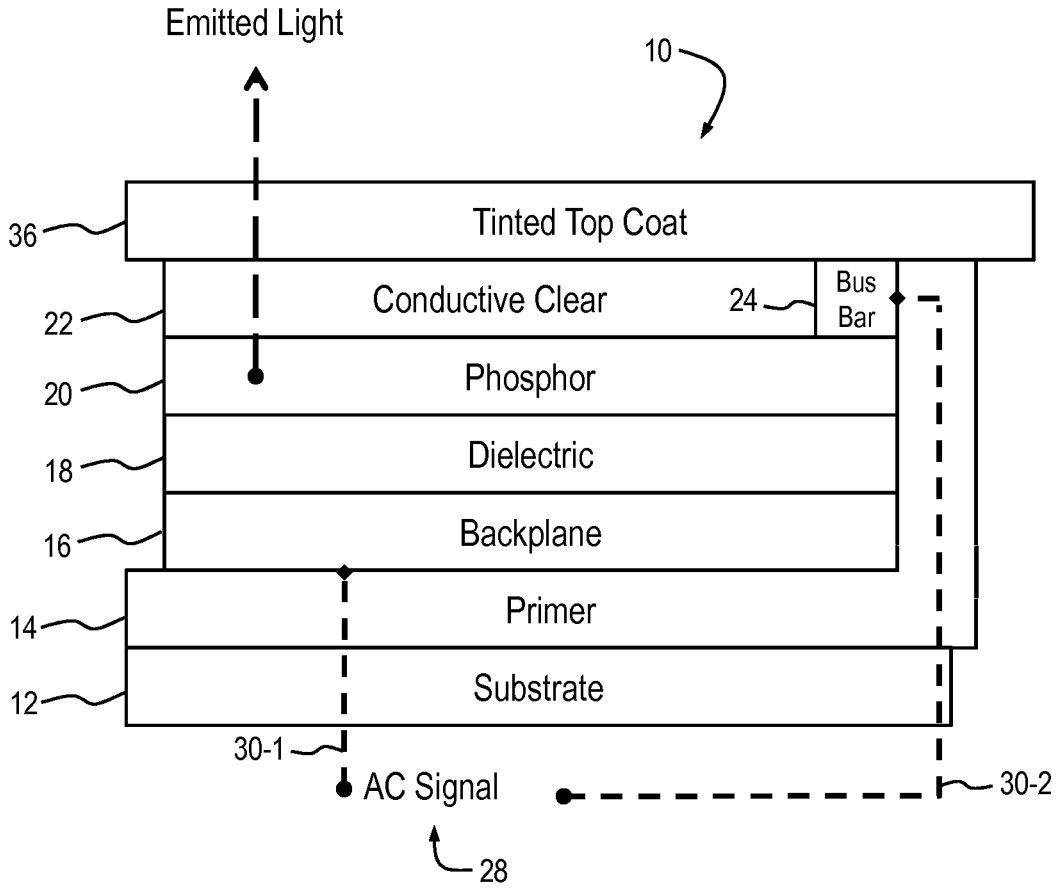
FIG. 8 is a schematic layer diagram showing light passing through the tinted overcoat of FIG. 6, providing an augmenting color effect to reflected light.

In other embodiments reflected light and/or emitted light may be utilized to manipulate the apparent color emitted by EL lamp 10. Under ambient conditions, the apparent color of a surface is determined by the absorption and reflection of various frequencies of light. Therefore, it is possible to effect a modification or change of apparent color by selective employment of colored phosphors in conjunction with tinted overcoats. FIG. 7 shows an EL lamp with reflected light modifying the color of EL lamp 10, while FIG. 8 shows emitted light modifying the apparent color of light emitted by the EL lamp.

Figure 9:
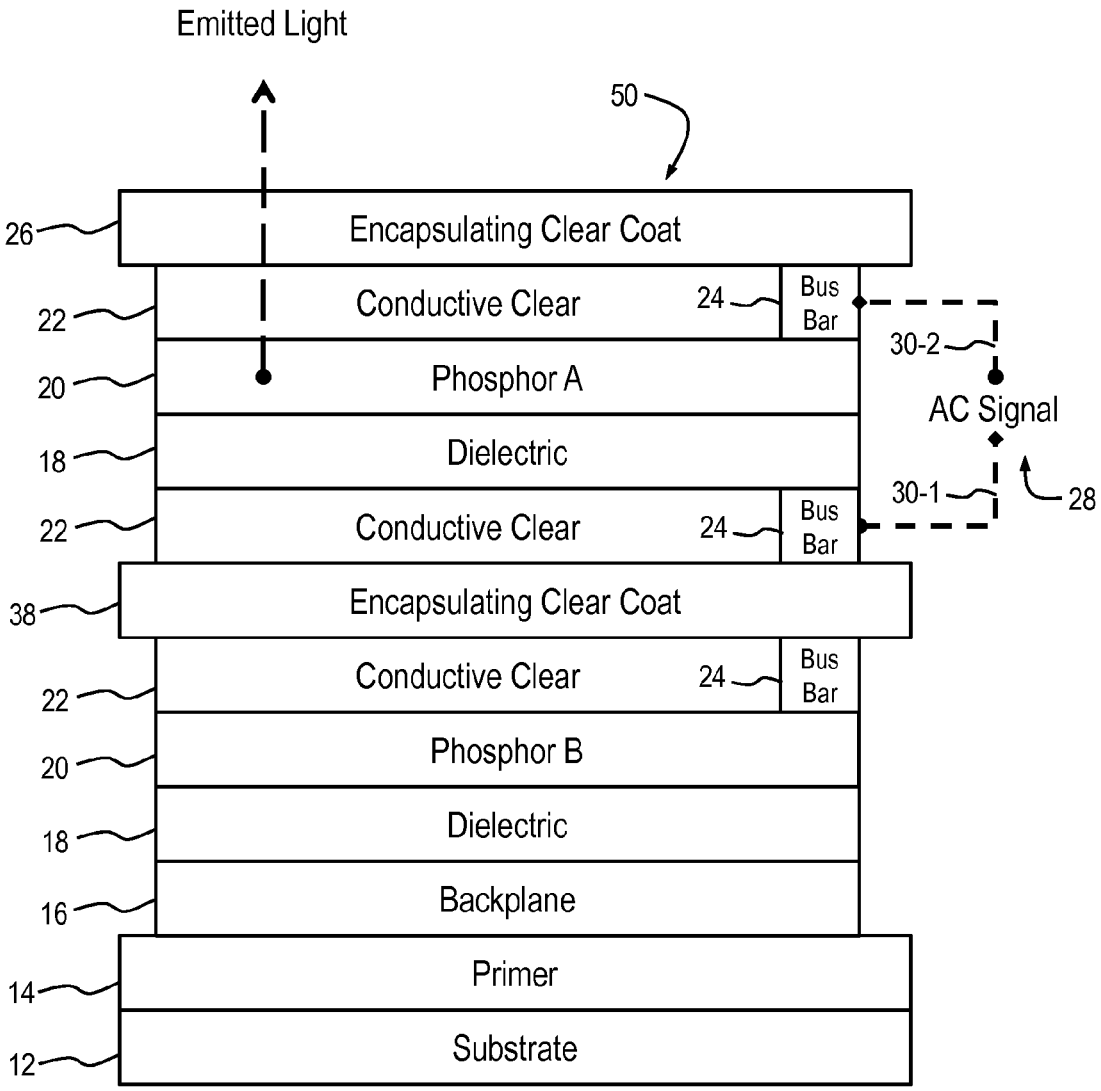
FIG. 9 is a schematic layer diagram of a multiple-layer EL lamp with top-layer wiring according to an embodiment of the present invention.
Figure 10:
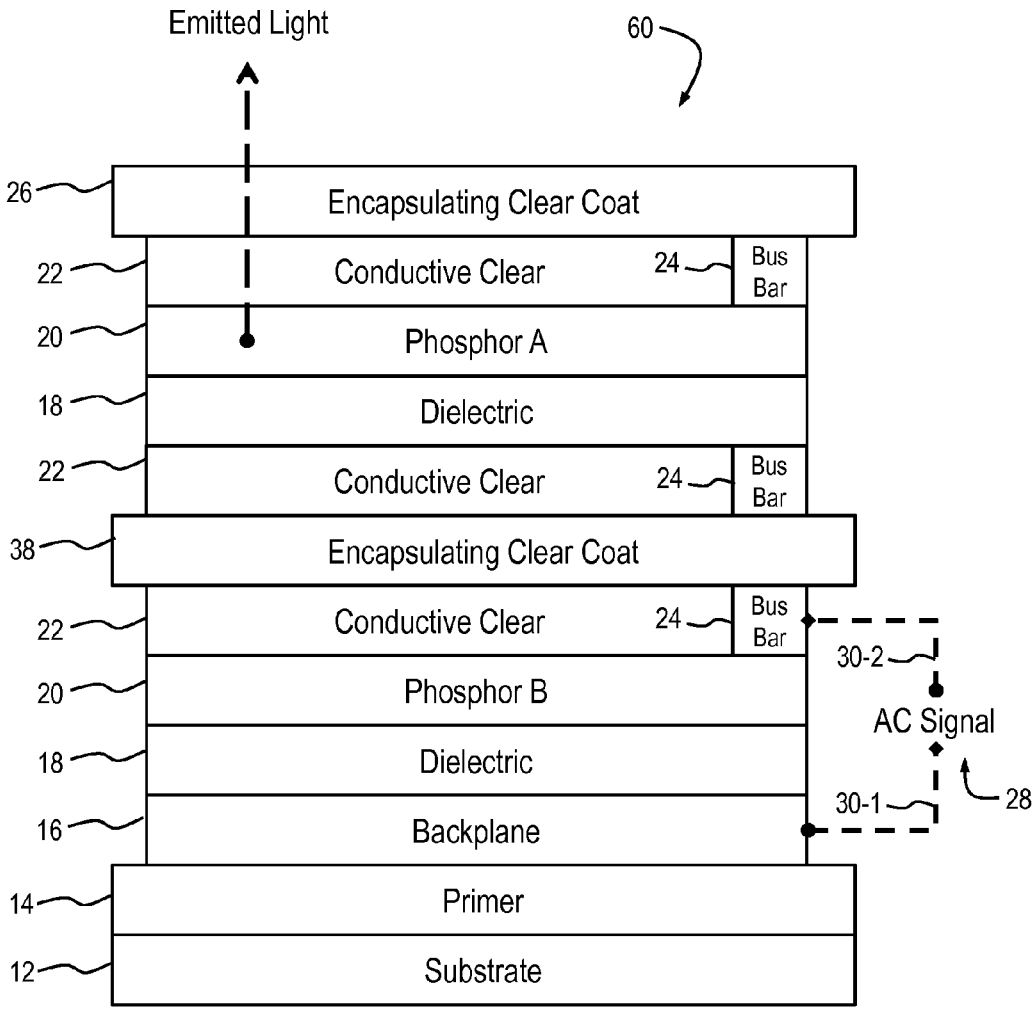
FIG. 10 is a schematic layer diagram of a multiple-layer EL lamp with bottom-layer wiring according to another embodiment of the present invention.
Figure 11:
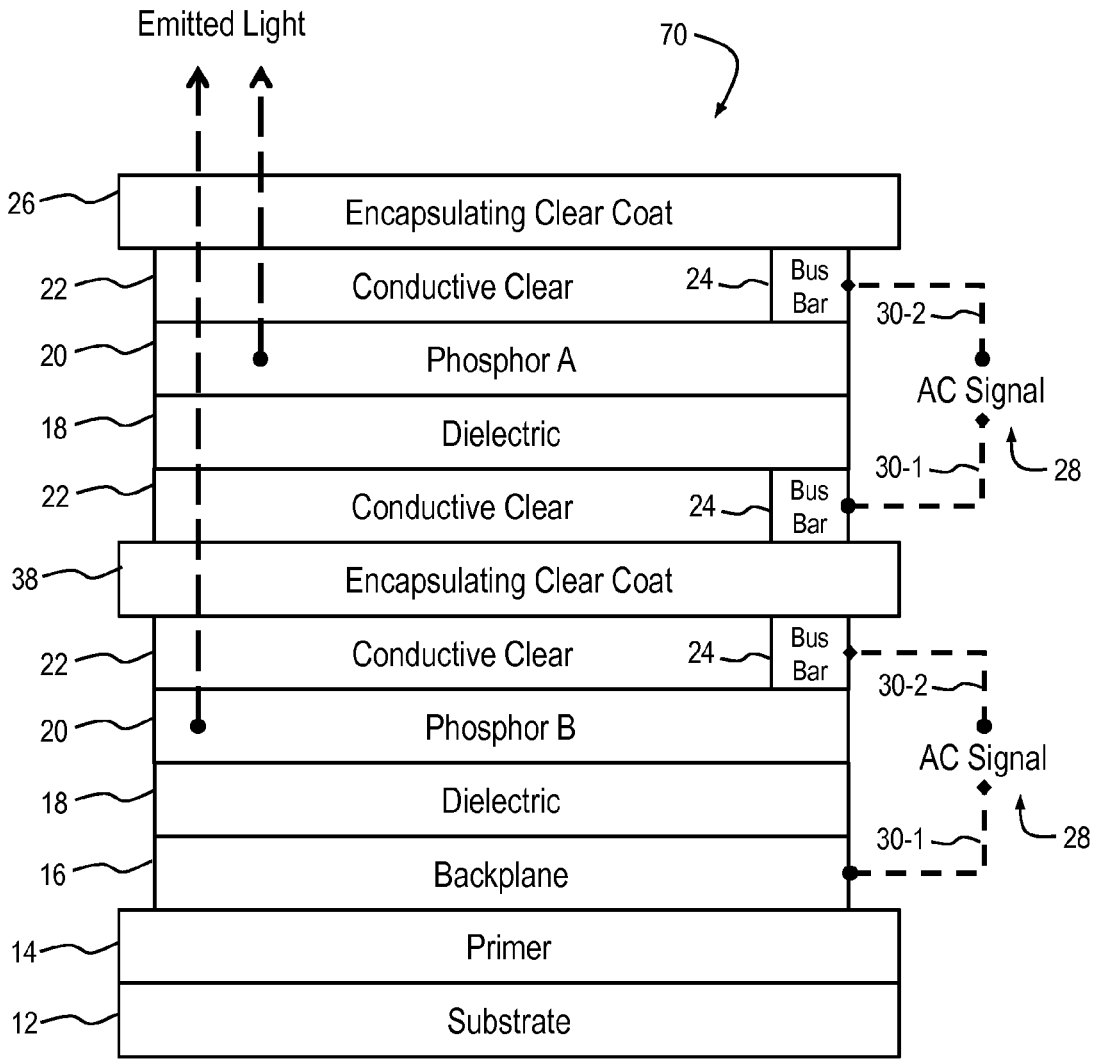
FIG. 11 is a schematic layer diagram of a multiple-layer EL lamp with dual-layer wiring according to yet another embodiment of the present invention.

Both the $BaTiO_3$ and ZnS particulate components of dielectric layer 18 and phosphor layer 20 respectively each exhibit significant properties of optical translucence to light at visible wavelengths. As a result, it is possible to directly superimpose layers of EL lamp 10, separated by a layer of an optically generally transparent encapsulant 38, to take advantage of these properties. By alternatively or coincidentally energizing the respective layers, substantial modification of apparent color is achievable. Combining this technique with the previously described tinting and reflective/emissive top coating procedures presents a wide array of possibilities for customization of the base EL lamp 10. FIG. 9 shows a multiple-layer configuration EL lamp 50 with top layer wiring, FIG. 10 shows a multiple layer configuration EL lamp 60 with bottom layer wiring, and FIG. 11 shows a multiple layer configuration EL lamp 70 with dual layer wiring. EL lamps 50, 60, 70 are otherwise similar to EL lamp 10 in materials and construction.

Figure 12:
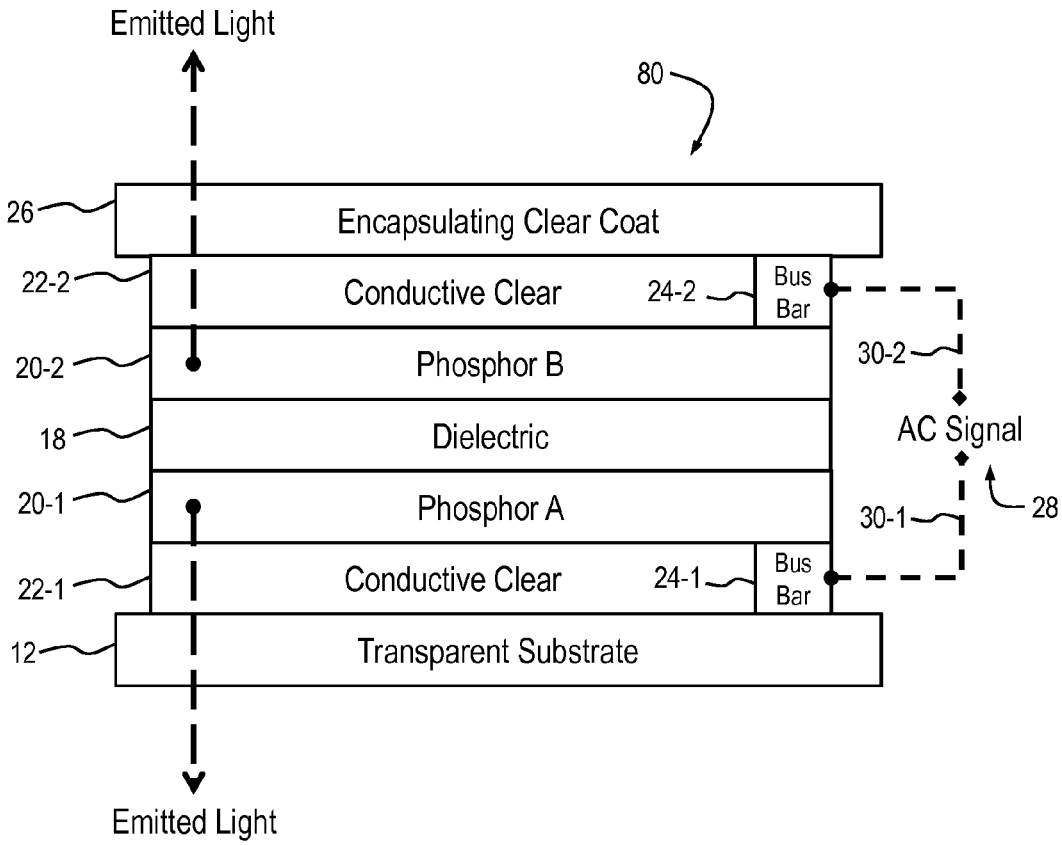
FIG. 12 is a schematic layer diagram of a multiple-layer EL lamp with dual-layer wiring according to still another embodiment of the present invention.

An EL lamp 80 is shown in FIG. 12 according to still another embodiment of the present invention. EL lamp 80 includes a substrate 12, which preferably is made of a generally transparent material such as glass or plastic. In the stackup of EL lamp 80 a first bus bar 24-1 is applied to substrate 12. A first generally transparent electrode film layer 22-1 is applied upon first bus bar 24-1. A first phosphor layer 20-1 is applied upon first electrode film layer 22-1. A dielectric layer 18 is applied upon first phosphor layer 20-1. A second phosphor layer 20-2 is applied upon dielectric layer 18. A second generally transparent electrode film layer 22-2 is applied upon second phosphor layer 20-2. Finally, an encapsulating clear coat 26 is optionally applied upon second electrode film layer 22-2. EL lamp 80 is otherwise similar to EL lamp 10 in materials and construction.

In operation of EL lamp 80, AC signal 28 is applied to bus bars 24-1, 24-2 as shown in FIG. 12. The AC signal is electrically conducted from bus bars 24-1, 24-2 to electrodes 22-1, 22-2 respectively, generating an AC field across phosphor layers 20-1 and 20-2. Phosphor layers 20-1 and 20-2 are excited by the AC field, causing the phosphor layers to emit light. Light emitted by phosphor layer 20-1 is directed toward and though transparent substrate 12. Light emitted by phosphor layer 20-2 is emitted in an opposing direction, toward and through encapsulating clear coat 26.

Figure 13:
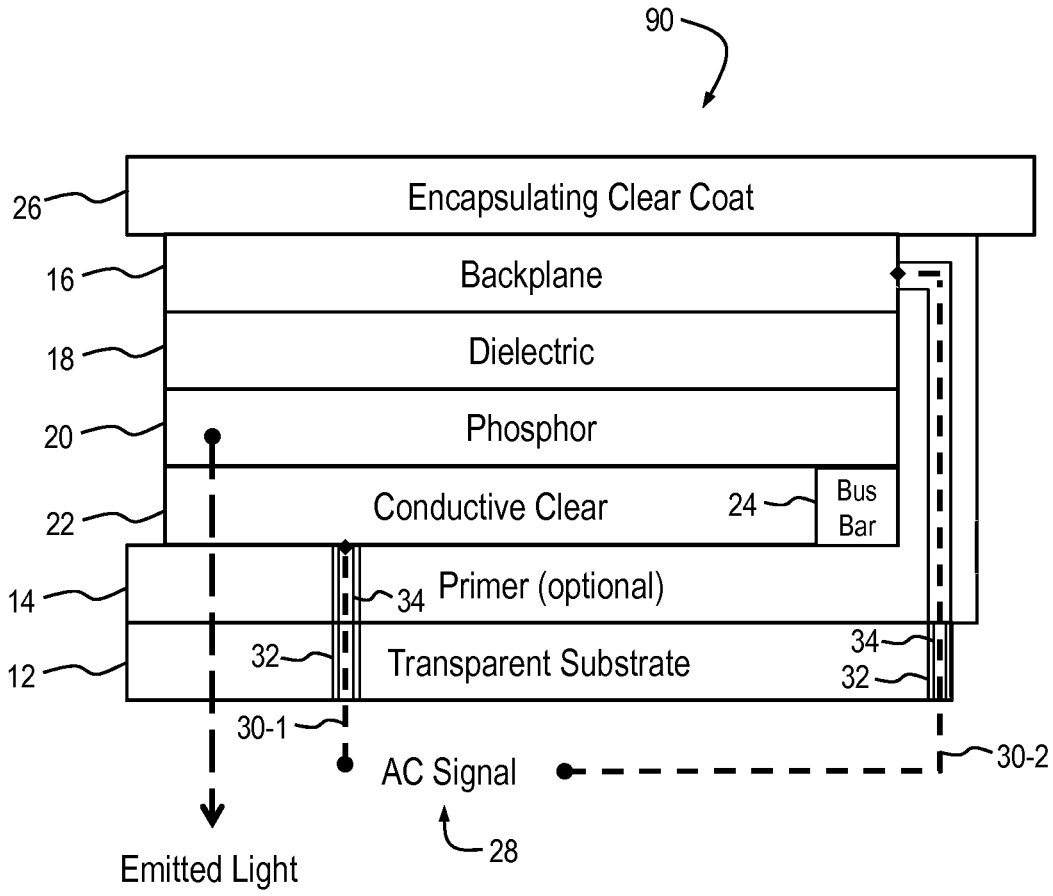
FIG. 13 is a schematic layer diagram of an EL lamp having a transparent substrate according to yet another embodiment of the present invention.

In one embodiment of the present invention the process of FIG. 2 may be slightly rearranged to produce an EL lamp 90 upon a generally transparent substrate 12, as shown in FIG. 13. The substrate 12 is selected at s102. If substrate 12 is electrically conductive an electrically insulative, generally transparent form of primer layer 14 of s104 may be applied to the substrate. One or more bus bars 24 of s118 are applied upon substrate 12 (or primer layer 14). The transparent electrode layer 22 of s120 is applied upon bus bar 24 and substrate 12 (or primer layer 14). The phosphor film layer 20 of s114 is applied upon the electrode film layer 22. The dielectric film layer 18 of s112 is applied upon the phosphor layer. The electrically conductive base backplane film layer 16 of s104 is applied upon dielectric film layer 18. Alternatively, a second generally transparent electrode layer 22 may be substituted for the base backplane film layer 16 of s104. The electrical connections of s108 may be made in any manner previously described. When constructed in this manner, light emitted by phosphor film layer 20 radiates through transparent electrode layer 22 and transparent substrate 12. EL lamp 90 is otherwise similar to EL lamp 10, detailed above.

A number of mechanisms and additives may be utilized to significantly modify and/or enhance the appearance of EL lamps produced in accordance with the present invention, delineated by whether the a specific additive provides either a passive, active or emissive function. Firstly, passive additives may be utilized. A passive additive is by definition a component integrated into the coating layers of any of EL lamps 10, 50, 60, 70, 80, 90 such that it does not emit light as a matter of function, but rather modifies emitted light to exhibit a desired quality. There are a number of materials, both naturally occurring and engineered, that may be utilized to take advantage of birefringent/polarizing/crystal optic properties to substantially enhance color and/or apparent brightness by employing a modified Fresnel lens effect.

An active additive is a material that does not emit light, but rather modifies light by the application of an electric field. A number of natural materials and a growing family of engineered materials, particularly polymers, exhibit significant electro-optic characteristics, in particular the modification of a material's optical properties by the application of an electrical field. Electrochromism, the ability of a material to change color due to the application of electric charge is of particular interest among these effects. Such materials may be incorporated with the phosphor layer 20 co-polymer or as a distinct layer between the phosphor and top electrode 22 layers.

Recent advances in engineered EL materials hold the promise of further enhancing the performance of EL lamps produced according to the present invention by either complimenting or replacing the doped-ZnS component of the base formula for phosphor layer 20. Among others, Gallium Nitride (GaN), Gallium Sulfide (GaS), Gallium Selenide ($GaSe_2$) and Strontium Aluminate (SrAl) compounds doped with various metal trace elements have demonstrated value as EL materials.

Another material that may be utilized to compliment or replace the doped-ZnS component of the base formula for phosphor layer 20 is Quantum Dots. Quantum Dots are a relatively recent technology that introduce a new emissive mechanism to the family of EL materials. Rather than emitting a given bandwidth (color) of light based upon characteristics of the dopant material, the emission frequency is determined by the physical size of the particle itself and thus may be "tuned" to emit light across a wide spectrum, including near-infrared. Quantum Dots also exhibit both photoluminescent as well as electroluminescent characteristics. These capabilities offer a number of potential functional benefits to EL lamps produced according to the present invention from either compounding traditional EL materials with Quantum Dots or by replacing traditional materials entirely with Quantum Dot technology depending on functional requirements.

While this invention has been shown and described with respect to a detailed embodiment thereof, it will be understood by those skilled in the art that changes in form and detail thereof may be made without departing from the scope of the claims of the invention.

What is claimed is:

1. A process for producing a conformal electroluminescent system, comprising the steps of:

selecting a substrate;

applying a base backplane film layer upon the substrate using an aqueous-based, electrically conductive backplane material;

applying a dielectric film layer upon the backplane film layer using an aqueous-based dielectric material;

applying a phosphor film layer upon the dielectric film layer using an aqueous-based phosphor material, the phosphor film layer being excited by an ultraviolet radiation source during application, the ultraviolet radiation source providing visual cues while the phosphor film layer is being applied, the application of the phosphor film layer being adjusted in response to the visual cues to apply a generally uniform distribution of the phosphor material upon the dielectric film layer;

applying an electrode film layer upon the phosphor film layer using an aqueous-based, substantially transparent, electrically conductive electrode material, the backplane film layer, dielectric film layer, phosphor film layer, and electrode film layer each being applied by spray conformal coating;

and further including the step of formulating a composition for the dielectric film layer, comprising:

providing about a 2:1 solution of co-polymer and dilute ammonium hydroxide;

pre-wetting a predetermined quantity of barium titanate in a predetermined quantity of ammonium hydroxide; and adding the pre-wetted barium titanate to the solution of co-polymer and dilute ammonium hydroxide to form a supersaturated suspension, wherein the phosphor film layer is excitable by an electrical field established across the phosphor film layer upon application of an electrical charge between the backplane film layer and the electrode film layer such that the phosphor film layer emits electroluminescent light.

2. The process of claim 1, further including the step of selecting a dielectric material having both electrically insulative and permittive properties, the dielectric material further comprising at least one of a titanate, an oxide, a niobate, an aluminate, a tantalate, and a zirconate material, the dielectric material further being suspended in an ammonia aqueous solvent.

3. The process of claim 1, further including the step of selecting a dielectric material having electrically insulative and permittive properties, the dielectric material further having photorefractive properties to facilitate the propagation of light through superimposed layers of the device.

4. The process of claim 1, further including the step of selecting, for the phosphor material, a semi-conductive coating composition having phosphors encapsulated within a highly electrostatically permeable polymer matrix.

5. The process of claim 1, further including the step of selecting, for the phosphor material, a coating composition containing quantum dots or zinc sulfide-based phosphors doped with at least one of copper, manganese and silver.

6. A process for producing a conformal electroluminescent system, comprising the steps of:

selecting a generally transparent substrate;

applying an electrode film layer upon the substrate using an aqueous-based, substantially transparent electrically conductive electrode material;

applying a phosphor film layer upon the electrode film layer using an aqueous-based phosphor material, the phosphor film layer being excited by an ultraviolet radiation source during application, the ultraviolet radiation source providing visual cues while the phosphor film layer is being applied, the application of the phosphor film layer being adjusted in response to the visual cues to apply a generally uniform distribution of the phosphor material upon the dielectric film layer;

applying a dielectric film layer upon the phosphor layer using an aqueous-based dielectric material;

applying a base backplane film layer upon the dielectric film layer using an aqueous-based, electrically conductive backplane material, the backplane film layer, dielectric film layer, phosphor film layer, and electrode film layer each being applied by spray conformal coating; and further including the step of formulating a composition for the dielectric film layer, comprising:

providing about a 2:1 solution of co-polymer and dilute ammonium hydroxide;

pre-wetting a predetermined quantity of barium titanate in a predetermined quantity of ammonium hydroxide; and adding the pre-wetted barium titanate to the solution of co-polymer and dilute ammonium hydroxide to form a supersaturated suspension, wherein the phosphor film layer is excitable by an electrical field established across the phosphor film layer upon application of an electrical charge between the backplane film layer and the electrode film layer such that the phosphor film layer emits electroluminescent light.

7. The process of claim 6, further including the step of selecting a dielectric material having both electrically insulative and permittive properties, the dielectric material further comprising at least one of a titanate, an oxide, a niobate, an aluminate, a tantalate, and a zirconate material, the dielectric material further being suspended in an ammonia aqueous solvent.

8. The process of claim 6, further including the step of selecting a dielectric material having electrically insulative and permittive properties, the dielectric material further having photorefractive properties to facilitate the propagation of light through superimposed layers of the device.

9. The process of claim 6, further including the step of selecting, for the phosphor material, a semi-conductive coating composition having phosphors encapsulated within a highly electrostatically permeable polymer matrix.

10. The process of claim 6, further including the step of selecting, for the phosphor material, a coating composition containing quantum dots or zinc sulfide-based phosphors doped with at least one of copper, manganese and silver.

11. A process for producing a conformal electroluminescent system, comprising the steps of:

selecting a generally transparent substrate;

applying a first electrode film layer upon the substrate using an aqueous-based, substantially transparent, electrically conductive electrode material;

applying a first phosphor film layer upon the electrode film layer using an aqueous-based phosphor material, the first phosphor film layer being excited by an ultraviolet radiation source during application, the ultraviolet radiation source providing visual cues while the first phosphor film layer is being applied, the application of the first phosphor film layer being adjusted in response to the visual cues to apply a generally uniform distribution of the phosphor material upon the dielectric film layer;

applying a dielectric film layer upon the phosphor film layer using an aqueous-based dielectric material;

applying a second phosphor film layer upon the electrode film layer using the phosphor material, the second phosphor film layer being excited by an ultraviolet radiation source during application, the ultraviolet radiation source providing visual cues while the second phosphor film layer is being applied, the application of the second phosphor film layer being adjusted in response to the visual cues to apply a generally uniform distribution of the phosphor material upon the dielectric film layer;

applying a second electrode film layer upon the second phosphor layer using the electrode material; and further including the step of formulating a composition for the dielectric film layer, comprising:

providing about a 2:1 solution of co-polymer and dilute ammonium hydroxide;

pre-wetting a predetermined quantity of barium titanate in a predetermined quantity of ammonium hydroxide; and adding the pre-wetted barium titanate to the solution of co-polymer and dilute ammonium hydroxide to form a supersaturated suspension, the first electrode film layer, first phosphor film layer, dielectric film layer, second phosphor film layer, and second electrode film layer each being applied by spray conformal coating, wherein the first and second phosphor film layers are excitable by an electrical field established across the first and second phosphor film layers upon application of an electrical charge between the first electrode film layer and the second electrode film layer such that the device emits electroluminescent light, the electroluminescent light being emitted on opposing sides of the substrate.

12. The process of claim 11, further including the step of selecting a dielectric material having both electrically insulative and permittive properties, the dielectric material further comprising at least one of a titanate, an oxide, a niobate, an aluminate, a tantalate, and a zirconate material, the dielectric material further being suspended in an ammonia aqueous solvent.

13. The process of claim 11, further including the step of selecting a dielectric material having electrically insulative and permittive properties, the dielectric material further having photorefractive properties to facilitate the propagation of light through superimposed layers of the device.

14. The process of claim 11, further including the step of selecting, for the phosphor material, a semi-conductive coating composition having phosphors encapsulated within a highly electrostatically permeable polymer matrix.

15. The process of claim 11, further including the step of selecting, for the phosphor material, a coating composition containing quantum dots or zinc sulfide-based phosphors doped with at least one of copper, manganese and silver.

* * * * *